US005632712A

United States Patent [19]

Heinz

[11] Patent Number: 5,632,712

[45] Date of Patent: May 27, 1997

[54] CARTON SEALING APPARATUS AND METHOD

[75] Inventor: Daniel J. Heinz, Joppa, Md.

[73] Assignee: Lever Brothers Company, Division of Conopco, Inc., New York, N.Y.

[21] Appl. No.: 474,843

[22] Filed: Jun. 7, 1995

Related U.S. Application Data

[63] Continuation of Ser. No. 375,081, Jan. 17, 1995, abandoned, which is a continuation of Ser. No. 129,796, Sep. 30, 1993, abandoned, which is a continuation of Ser. No. 829,103, Jan. 31, 1992, abandoned, which is a continuation-in-part of Ser. No. 816,417, Dec. 31, 1991, abandoned.

[51] Int. Cl.[6] ..... B31B 1/62; B31B 1/64

[52] U.S. Cl. ..... 493/142; 493/178; 493/179; 53/387.2

[58] Field of Search ..... 493/141–146, 493/177, 178, 179, 182, 183; 53/387.2, 387.3; 156/580, 581, 583.3, 583.8, 583.91

[56] References Cited

U.S. PATENT DOCUMENTS

| | | | |
|---|---|---|---|
| 1,136,354 | 4/1915 | Martin . | |
| 1,161,227 | 11/1915 | Labomearde . | |
| 1,482,197 | 1/1924 | Kimball . | |
| 1,503,126 | 7/1924 | Kimball et al. . | |
| 1,583,371 | 5/1926 | Rich . | |
| 1,639,283 | 8/1927 | Bergstein . | |
| 1,887,699 | 11/1932 | Reid . | |
| 2,135,806 | 11/1938 | Fermann et al. . | |
| 2,266,054 | 12/1941 | Lowey et al. . | |
| 2,421,373 | 6/1947 | Cozza . | |
| 3,067,309 | 12/1962 | Chinn . | |
| 3,216,175 | 11/1965 | Stohlquist . | |
| 3,236,026 | 2/1966 | Evans . | |
| 3,263,398 | 8/1966 | Gobalet . | |
| 3,291,008 | 12/1966 | Pierce . | |
| 3,292,343 | 12/1966 | Schroeder . | |
| 3,377,767 | 4/1968 | Franz . | |
| 4,012,996 | 3/1977 | Stolkin et al. . | |
| 4,080,241 | 3/1978 | Grevich et al. . | |
| 4,102,252 | 7/1978 | Reichert . | |
| 4,173,921 | 11/1979 | Mack | 53/387.2 |
| 4,233,798 | 11/1980 | Helding | 53/76 |
| 4,428,742 | 1/1984 | Deal . | |
| 4,696,392 | 9/1987 | Chisolm . | |
| 4,817,364 | 4/1989 | Good . | |
| 5,085,029 | 2/1992 | Esper . | |
| 5,141,591 | 8/1992 | Boek et al. . | |

OTHER PUBLICATIONS

Pneumatic Scale Corp. Trade Literature Jun. 1985.

Delamere Williams Bulletin No. 76E; "*Velocitron Packagers*,", Dated Literature; Jun. 24, 1985.

*Primary Examiner*—Jack W. Lavinder

*Attorney, Agent, or Firm*—Gerard J. McGowan, Jr.

[57] ABSTRACT

A process and apparatus for sealing cartons. Cartons are conveyed past one or more sealing bars which yieldingly apply pressure to a sealing area thereof. The bars are adjustable to a predetermined pressure by adjusting the length of the spring between the bars and a base. The bars are, therefore, preferably spring biased.

15 Claims, 5 Drawing Sheets

CARTON SEALING APPARATUS AND METHOD

This is a Continuation application of Ser. No. 08/375,081 filed Jan. 17, 1995, now abandoned which is a continuation of Ser. No. 08/129,796 filed Sep. 30, 1993, now abandoned which is a continuation of Ser. No. 07/829,103 filed Jan. 31, 1992, now abandoned which is a continuation-in-part of Ser. No. 07/816,417 filed Dec. 31, 1991 now abandoned.

BACKGROUND OF THE INVENTION

Often, consumer products are packaged in accordance with the following procedure. First, a folded tubular carton precursor is formed from a carton blank by adhering a thin panel called a glue flap, which is appended to a side panel of the carton, to a side panel of the carton. The tubular blank is usually presented in a flattened form to a machine which begins erection of the carton by opening the tube and squaring the carton.

Subsequent to squaring the tubular carton, a first end of the carton is closed by folding the bottom minor flaps inwardly so that they are perpendicular to the side panels. The inner major flap is then provided with a hot melt or other adhesive and folded over the minor flaps. Hot melt or other adhesive is applied to the outer major flap, which is then folded over the inner major flap. Pressure is applied to the outer major flap to effect fully the sealing of the carton. The other end of the carton is then likewise closed by folding the minor flaps so that they are disposed perpendicularly to the side panels, applying hot melt or other adhesive to the inner major flaps, folding the inner major flap over the minor flaps, applying hot melt or other adhesive to the outer major flap, folding the outer major flap on top of the inner major flap, and applying pressure to the outer major flap.

Pressure is generally applied to the outer major flaps during closing thereof by means of a bar or series of bars which contact the surface of the outer major flaps. Unfortunately, application of pressure from a single bar may be uneven. Moreover, even where multiple bars are used, it may not be possible to apply sufficient pressure to all portions of the outer major flap to effect a seal having the necessary integrity for the product contained within the package. Seal integrity can be particularly important for certain types of products such as certain powdered laundry and other detergents.

Application of pressure evenly across the top of the outer major flap is of particular importance in cartons having so called "shied" flaps. In shied flap cartons one or more of the outside and inside major flaps do not extend across the entire width of the carton. This is advantageous in that it conserves paperboard and lowers the cost of the product. However, it will be appreciated that shied flaps will be uneven and that this increases the difficulty in effecting a complete, continuous seal. The problems in effecting a complete seal are particularly acute in the case of the first end to be sealed because the pressure which can be applied is particularly limited since the flaps of the opposite end are still open and cannot bear much weight.

Apart from "shied flap" cartons, producing an effective seal is also particularly difficult for cartons which for any reason have a top or bottom surface which is not flat.

Equipment utilizing stationary, individually adjustable bars for sealing cartons is known.

SUMMARY OF THE INVENTION

It has been discovered that problems encountered due to uneven pressure applied to the major flaps can be avoided if a plurality of sealing bars which are selectively self-adjustable are employed so as to place adequate pressure on each portion of the upper major flap so as to effect a secure seal. Thus, sealing of cartons, particularly "shied flap" or other cartons having an uneven sealing surface, is effected by a series of vertically movable bars that can individually apply varying degrees of pressure against the outside surface of the carton flap. The bars utilized in the present invention may be both pre-adjusted in anticipation of expected variations in the surfaces of the end flaps, and self adjusting for actual variations encountered in the flatness of the carton flaps. Advantageously, the bars are comprised of a low friction material such as Teflon (polytetrafluoroethylene). The individual self-adjusting characteristics of the bars can be obtained by, e.g., spring loading them.

Particularly surprising has been the discovery that bars having a length of approximately one machine pitch (that is, the length of the carton plus conveyer block width) are adequate to effect a seal having sufficient integrity to contain detergent powder without the release of fine particles.

For a more complete understanding of the above and other features and advantages of the invention, reference should be made to the following detailed description of preferred embodiments and to the accompanying drawings.

DETAILED DESCRIPTION OF THE INVENTION

Figure 1:
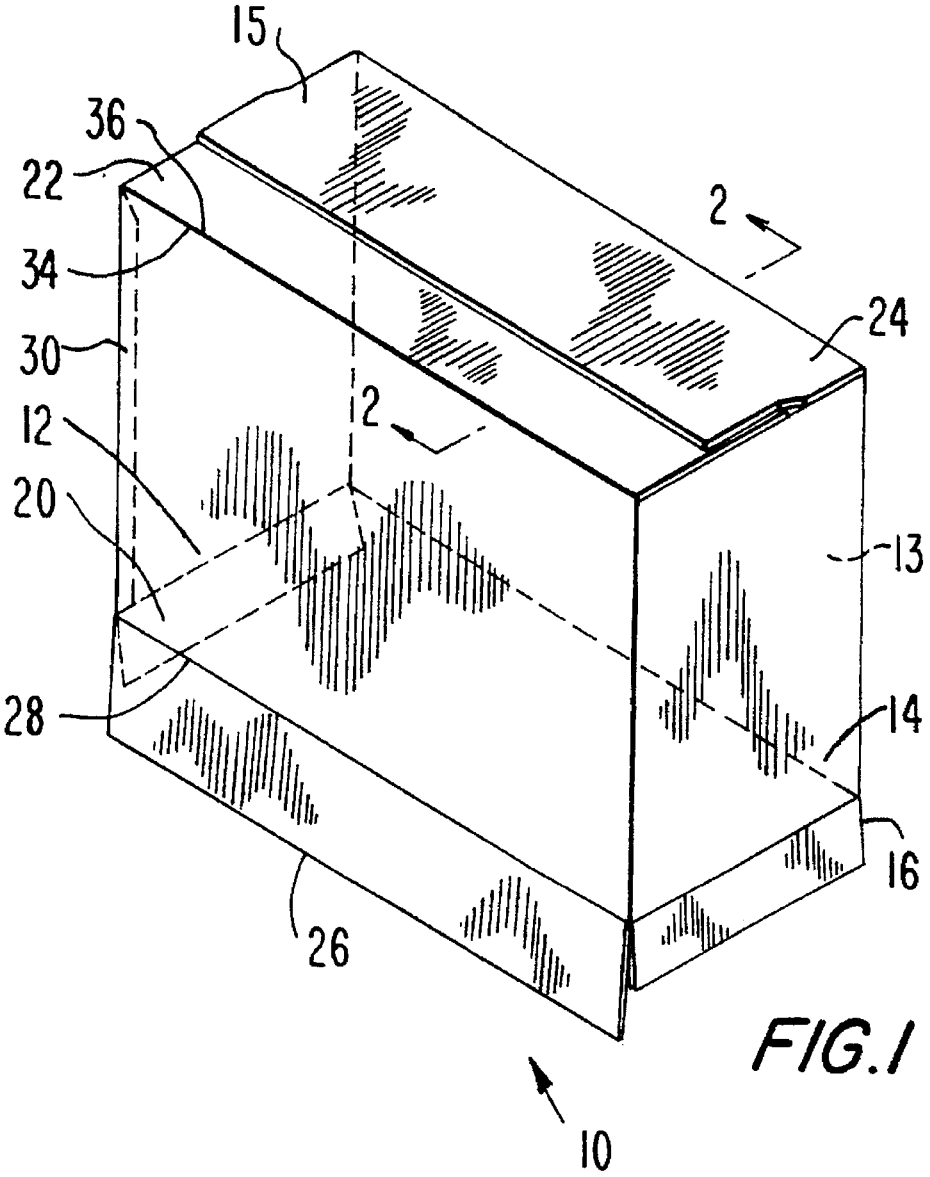
FIG. 1 is a perspective view of a carton having its upper major flaps folded downwardly prior to sealing.

FIG. 1 shows a shied flap carton 10 which can be sealed by means of the present apparatus and process. Carton 10 comprises rear panel 12 and second side panel 14. A front panel 13 is parallel to rear panel 12 and a first side panel 15 is disposed parallel to second side panel 14. Bottom minor flaps 16 and 20 are appended to the second and first side panels, respectively. Likewise, top minor flaps (not shown) are each appended to the first and second side panels. Upper inner major flap 22 and upper outer major flap 24 are appended respectively to rear panel 12 and the front panel 13. Similarly, bottom inner major flap 26 and the outer major flap (not shown) are respectively appended to rear panel 12 and the front panel 13.

Rear panel 12, second side panel 14, the front panel 13 and the first side panel are separated respectively from bottom inside major flap 26, bottom minor flap 16, the bottom outside major flap and bottom minor flap 20 by scoreline 28. The rear panel 12 includes a thin glue flap 30 which is bonded to first side panel 15.

Upper inner major flap 22, the second upper minor flap, upper outer major flap 24 and the first upper minor flap are separated respectively from rear panel 12, second side panel 14, the front panel 13 and the first side panel by scoreline 34.

Upper outer major flap 24, upper inner major flap 22, the lower outer major flap and lower inner major flap 26 are all shied flaps. That is, each of these flaps has a width which is shorter than that which is needed to traverse the full width of the carton. For instance, upper outer major flap 24 does not extend completely from the portion of scoreline 34 adjoining the front panel 13 to the portion of scoreline 34 adjoining rear panel 12. Rather, upper outer major panel 24 stops short of scoreline 34 at edge 36.

Figure 2:
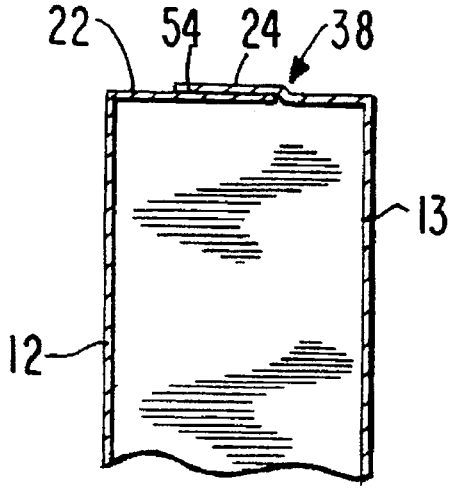
FIG. 2 is a cross-section along the lines 2—2 of FIG. 1.
Figure 4:
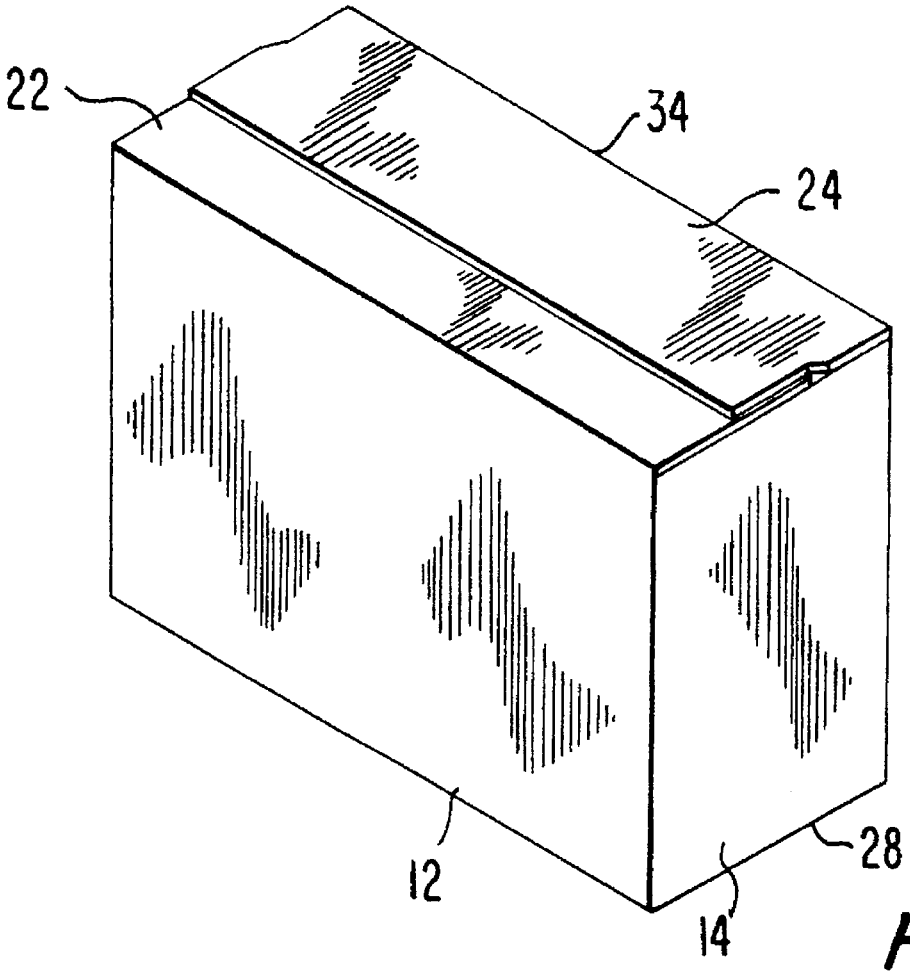
FIG. 4 is a perspective view of a shied flap carton which has been sealed.

As best seen in FIG. 2, the presence of shied flaps caused a lack of evenness across the top of the carton. A similar unevenness is caused across the bottom end as well. The presence of shied flap 22 causes flap 24 to experience a protrusion at 38 particularly after pressure is applied via a sealing bar. If even pressure were applied across the top of the carton illustrated in FIG. 2, a gap would be formed which would permit the escape of fine powdered particles from the carton.

Figure 3:
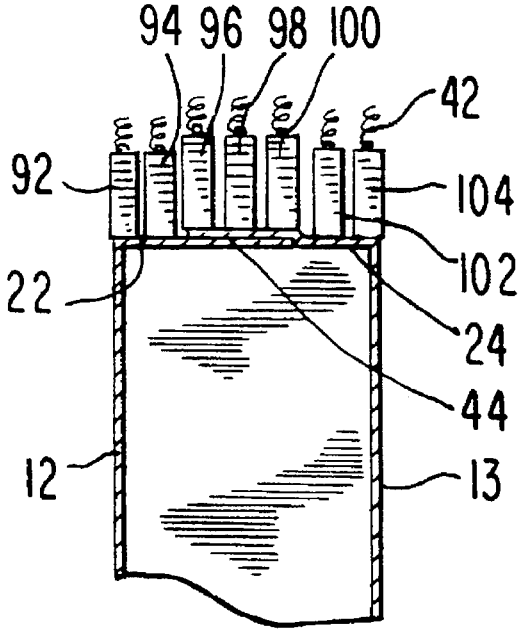
FIG. 3 is the carton of FIG. 2 having the bars of the present invention applied during sealing.

FIG. 3 illustrates a carton top to which is applied during sealing a series of self-adjusting adjustable bars in accordance with the present invention. Each of the sealing bars 92, 94, 96, 98, 100, 102 and 104 applies pressure to a different portion of the top flap. Each of the sealing bars is pre-adjusted in accordance with the expectation as to the height at which the pressure should be applied and the pressure which should be applied. Moreover, each of the sealing bars includes a spring 42 (shown partially in FIG. 3) which permits instantaneous adjustment of the pressure, as will be explained in more detail hereinbelow. During the sealing operation, hot melt or other adhesive 44 which is pre-applied to one or more of the major flaps may be spread throughout the overlap between the flaps as seen in FIG. 3 or in accordance with some other pattern. Adhesive may be applied to minor flaps as well.

Figure 5:
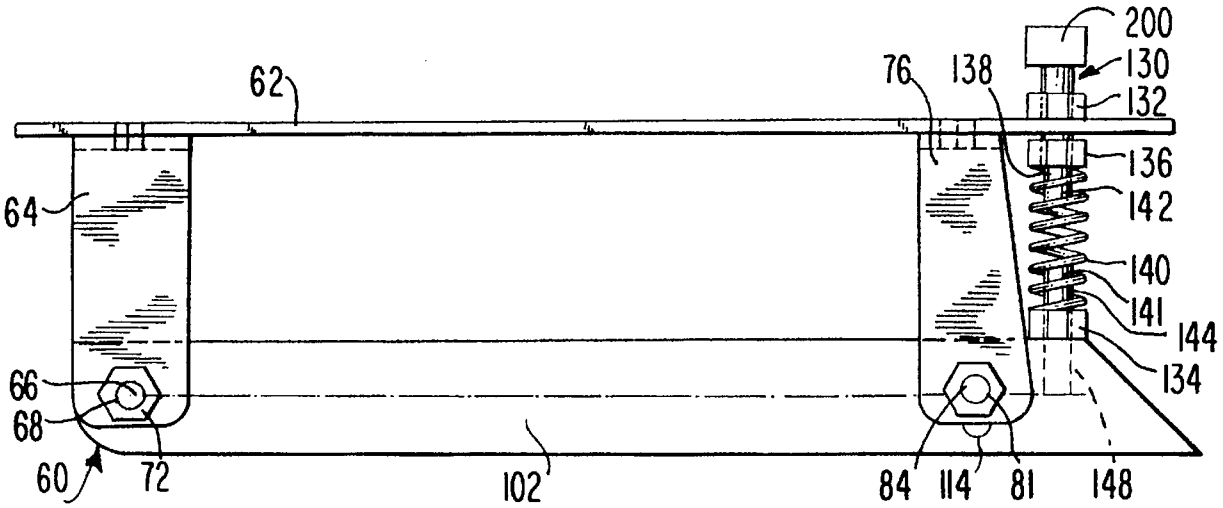
FIG. 5 is a side elevational view of the apparatus of the invention.
Figure 6:
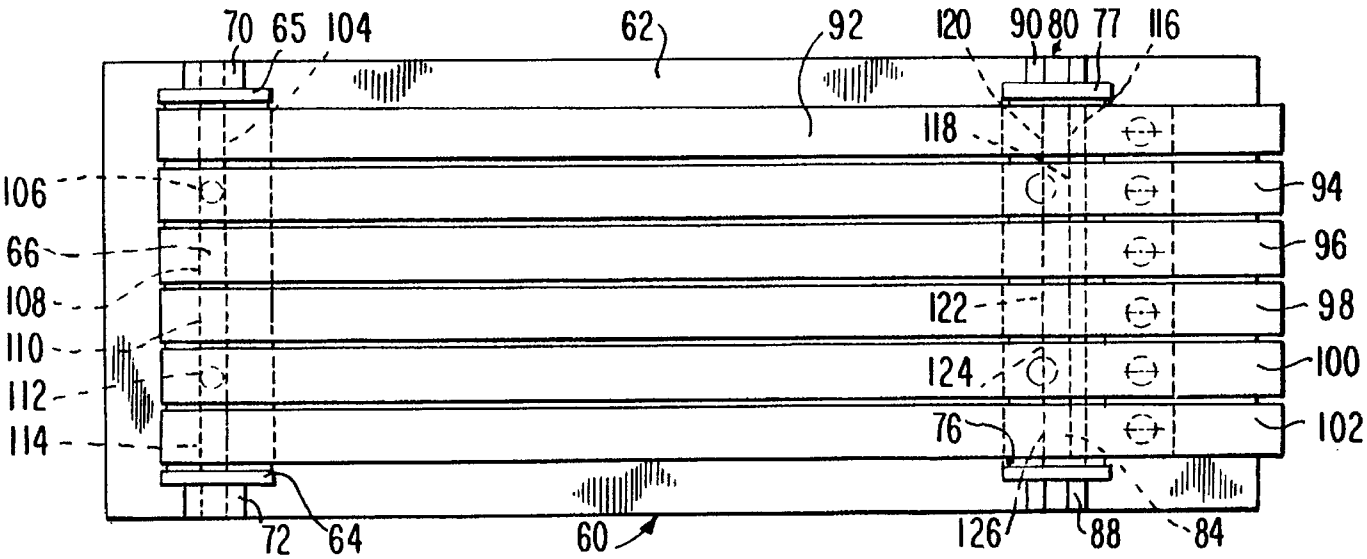
FIG. 6 is a bottom plan view of the apparatus of the invention.

Apparatus 60 (FIGS. 5 and 6) is used to apply pressure to the carton end. Apparatus 60 comprises base plate 62, first connecting flanges 64, 65 and rod 66 received within aperture 68 of connecting flanges 64 and 65. Rod 66 is fastened to connecting flanges 64, 65 by nuts 70, 72.

Base plate 62 is welded to second connecting flanges 76, 77 which include circular aperture 81 receiving second rod 84. Rod 84 is secured to second connecting flanges 76 and 77 by nuts 88 and 90. Sealing bars 92, 94, 96, 98, 100 and 102 receive rods 66 and 84 in elliptic apertures 104, 106, 108, 110, 112, 114, 116, 118, 120, 122, 124 and 126, respectively. The rear of the bars pivot on rod 66 the bars pivot at a single point. Preferably, the position of each of the bars may be individually adjusted to accomodate anticipated differences in sealing surfaces.

The distances between each sealing bar and plate 62 are adjustable. The adjustments in the distances between each respective sealing bar and plate 62 are accommodated by the elliptical shape of the aperture of the sealing bar.

Changes in the pressure exerted by the bars are effected by adjusting means 130. There is one adjusting means for each of the sealing bars. Adjusting means 130 includes jam nut 132 welded to plate 62. Adjusting means 130 includes handle 200, top screw 138, which includes threads and rod 142, nut 136 welded to screw 138, and spring 140 associated with the bottom of nut 136 at its first end. Lower screw 141, which includes threads and rod 144, is received within spring 140 at its second end and is in alignment with rod 142. At its second end, spring 140 is associated with nut 134, which is welded to screw 141. Screw 141 is threaded and continues into threaded bore 148 of the respective sealing bar.

Figure 7:
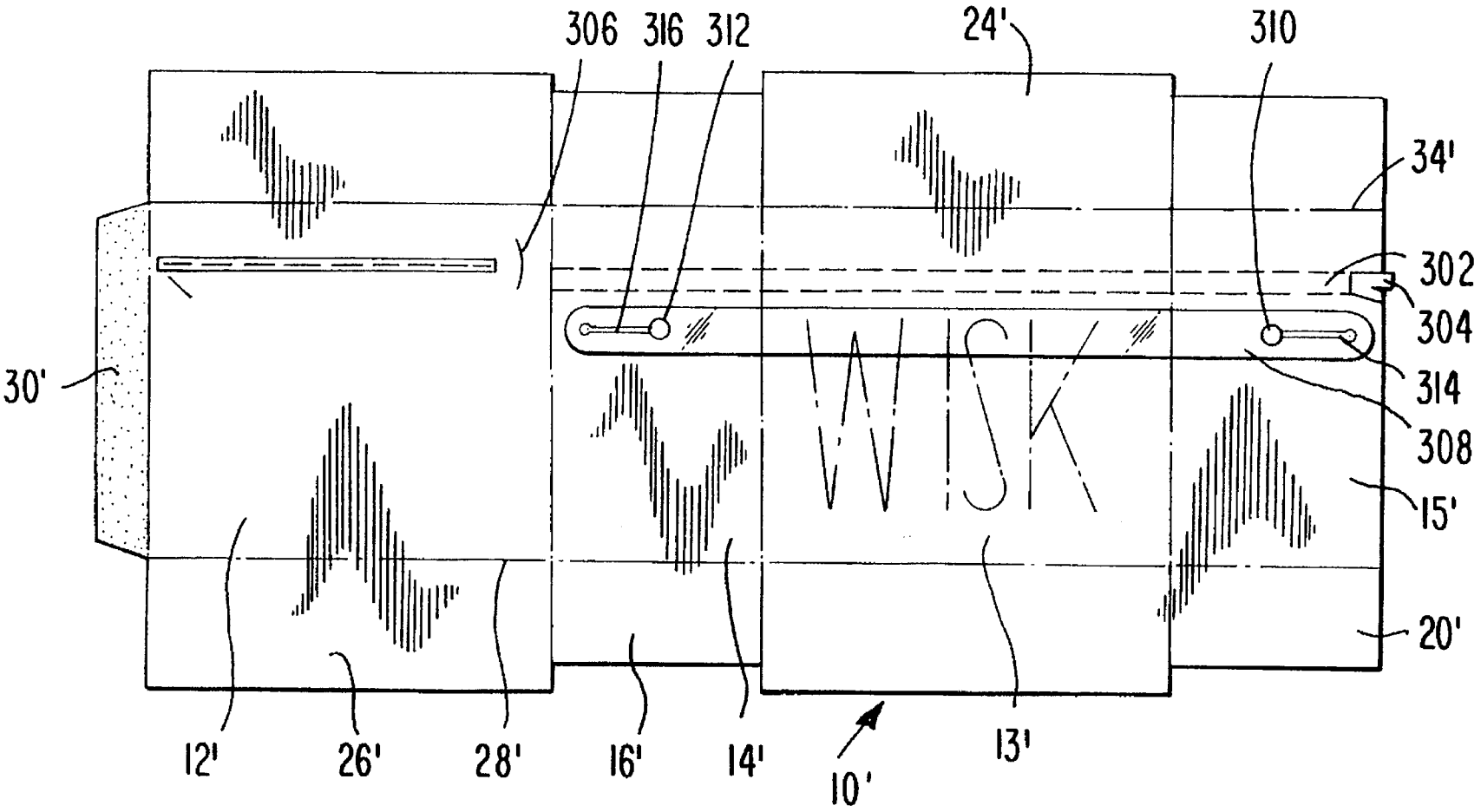
FIG. 7 is a top plan view of a carton blank which can be sealed in accordance with the present invention.

In FIG. 7, a carton blank which can be used in the formation of shied flap cartons is shown. Features corresponding to those of cartons illustrated above are denoted by primed numbers. In addition, carton blank 10 features a teartape 302, teartape handle 304, teartape stop 306, and handle 308 attached with rivets 310, 312, through dumbbell-shaped apertures 314, 316.

In operation, carton blanks are formed into flat tubular cartons by adhering glue flap 30 to first side panel 15. The flattened tubular cartons are then opened and squared, after which the upper minor flaps are folded inwardly so that they are disposed perpendicularly to the respective side panels to which they are appended. Then, upper inner major flap 22 is folded downwardly and hot melt or some other adhesive is applied thereto in the desired pattern. It will be appreciated that the adhesive may be applied prior to folding the flaps and/or to other flaps such as the inside of the outer major upper flap 24. Likewise, if desired, adhesive may be applied to the minor flaps.

Once the outer upper major flap 24 has been folded downwardly over the upper inner major flap 22, pressure is applied to the upper major flap to seal the major flaps together. Apparatus 60 is used to apply the pressure which will effect sealing. Carton 10 is conveyed past bars 92, 94, 96, 98, 100 and 102 so that its longitudinal axis is parallel to that of the bars. Carton 10 may be conveyed above or below the sealing bars. If the carton is conveyed above the sealing bars, the bars will be oriented in an inverted position to that shown in FIG. 5. The pressure exerted by each respective sealing bar is adjusted by turning handle 200 which turns screw 138 and nut 136, and changes the length of spring 140. Rod 144 is screwed into the sealing bars and locked into place by nut 134 and retains spring 140 in position against the appropriate sealing bar.

Since spring 140 forms a portion of the means separating plate 62 from the respective sealing bar, the positioning of the sealing bar is somewhat flexible. Therefore, as the sealing bar moves over a surface which is higher than anticipated, i.e., one which is higher than that for which the particular bar has been adjusted, the spring permits the bar to yield and therefore not to apply an inordinate amount of pressure. That is, the bar is yieldingly biased in application of the pressure. The elliptic aperture accomodates the yielding of the bar.

The sealing bars apply pressure to different portions of the flap lying adjacent to each other as determined in a direction transverse to the scorelines attaching the major flaps to the carton.

The ability to apply predetermined pressure yieldingly is particularly important since, as can be seen in FIG. 1, the bottom of the carton will be supported by major flaps 26 which will not be able to bear large amounts of weight. The major flaps are disposed parallel to the first panel outwardly of the carton. After one end has been sealed, typically, product is inserted into the carton and the other end will be sealed in a similar manner. It will be apparent that sealing of the second end will cause fewer difficulties in that the carton will be supported by the already sealed first end rather than by the not-so-rigid flaps.

Figure 8:
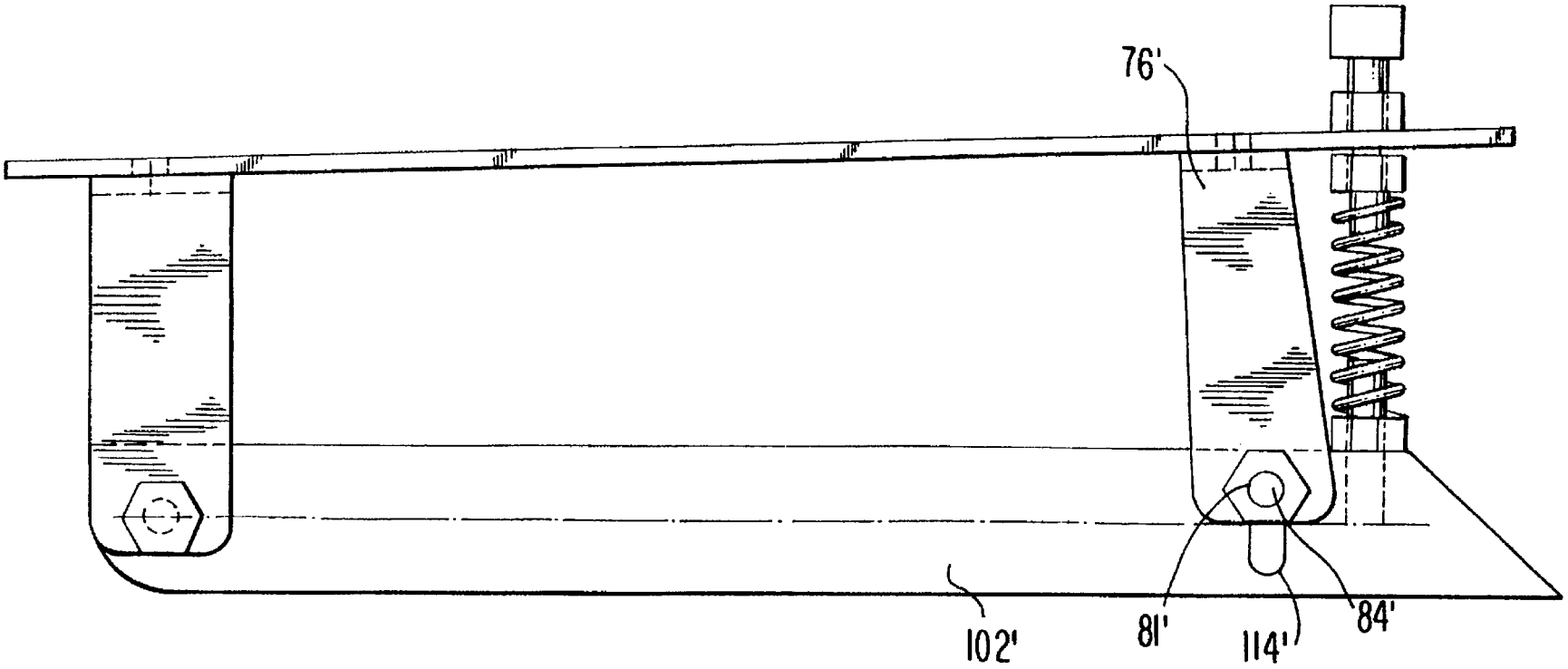
FIG. 8 is a side elevational view of the apparatus of the invention wherein the sealing bar is in an alternate position.

A preferred position for the sealing bar is shown in FIG. 8 wherein sealing bar 102' is pushed downwardly so that rod 84' is at the top of elliptic aperture 114' of the sealing bar. Further tightening of spring 140' will not further move the bar but will increase the pressure on the flaps by making the bar less yieldable. The elliptic apertures may be in different positions in the respective sealing bars if desirable to accomodate expected differences in the desired positions of the sealing bars. Expected differences in the desired levels of the sealing bars may also be accomodated by localized variations in the diameter and shape of the rod at the location of the respective bar.

It will be appreciated that at the various stages of erection and filling the carton may not necessarily be oriented in the same way top to bottom as it will ultimately be used by the consumer. Although reference has been made to the tops and bottoms of the carton, these do not necessarily refer to the ultimate top and bottom of the carton since it may be desirable to fabricate the carton in an orientation opposite to that in which it is ultimately used.

An advantage of the present apparatus and process is the fact that in a single machine pitch, i.e., a carton length plus conveyer block width, a secure seal can be effected by the present apparatus by applying more or less pressure in selected areas where leaking will most likely occur.

The apparatus and process of the invention are particularly suitable for containing detergent powders and providing a leak proof seal through which fine powders do not escape. The cartons are preferably made of paperboard, and are optionally laminated.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A process for sealing a squared carton having at least two major sealing flaps attached to said carton at scorelines which are disposed parallel to each other comprising conveying said carton in a direction parallel to said scorelines past a plurality of sealing bars preadjusted to provide a predetermined amount of pressure to a sealing area comprising said flaps on said squared carton; applying pressure via said plurality of sealing bars to said sealing area wherein the bars are yieldingly biased in applying said pressure to different portions of the flaps, wherein said sealing bars are disposed adjacent each other as determined in a direction transverse to said scorelines; and, independently preadjusting each of said sealing bars by rotating a screw which changes the length of a spring wherein the spring is attached to said sealing bar.

2. The process according to claim 1 wherein the major sealing flaps each extend less than the full width of the carton.

3. The process according to claim 1 wherein said sealing bars apply pressure to an outer major flap of said squared carton.

4. The process according to claim 1 wherein said squared carton comprises a front panel, a rear panel and two side panels and major and minor flaps at first and second ends and said sealing bar applies pressure to a first end of said squared carton and wherein at least one of said major or minor flaps at said second end is extended away from said carton and disposed outwardly of said carton parallel to said front panel while said sealing bar is applying pressure to said first end.

5. The process according to claim 4 further comprising placing adhesive on one of said inner or outer major flaps prior to application of the sealing bars.

6. The process according to claim 1 wherein said plurality of sealing bars are comprised of a low friction material.

7. An apparatus for sealing carton ends with at least two major sealing flaps attached to said carton at scorelines disposed parallel to each other comprising an apparatus base, sealing bars associated with said apparatus base, and yieldingly biased adjustable means for exerting pressure on said sealing bars, a plurality of said sealing bars being positioned to apply pressure to different portions of said major sealing flaps of the carton, a conveyor for moving the cartons past said plurality of sealing bars in a direction parallel to said scorelines wherein said different portions are disposed adjacent each other as determined in a direction transverse to said scorelines, said sealing bars being disposed adjacent each other as determined in a direction transverse to said scorelines, said sealing bars being capable of being individually preadjusted for exerting pressure, said yieldingly biased adjustable means for exerting pressure comprising a screw and spring combination attached to each of the sealing bars for varying the length of the spring, wherein at least one of said sealing bars includes two ends, said at least one of said sealing bars being associated with a pivoting rod at the first end and the distance between said at least one of said sealing bars and said base being adjustable at said second end, said at least one of said sealing bars being capable of pivoting on said pivoting rod at said first end, said pivoting rod being capable of being set at a fixed location.

8. The apparatus according to claim 7 wherein said plurality of sealing bars are comprised of a low friction material.

9. A process for sealing cartons with at least two major flaps attached to said carton at parallel scorelines comprising conveying a squared carton past sealing bars preadjusted to provide a predetermined amount of pressure to a sealing area including said major flaps on said squared carton and which bars apply pressure to said sealing area and are yieldingly biased in applying said pressure, a plurality of said sealing bars applying pressure to different portions of said major flaps, said portions and said sealing bars being adjacent to each other respectively as determined in a direction transverse to said scorelines, each of said sealing bars pivoting only at a single point, said cartons being conveyed in a direction parallel to said scoreline.

10. An apparatus for sealing carton ends having at least two major sealing flaps attached to the carton at parallel scorelines comprising an apparatus base, sealing bars associated with said apparatus base, means for conveying said cartons in a direction parallel to said scorelines, and yieldingly biased adjustable means for exerting pressure on said sealing bars, a plurality of said sealing bars being positioned to apply pressure to different portions of said sealing flaps, said different portions and said sealing bars being disposed adjacent each other respectively in a line transverse to the scorelines, said sealing bars being capable of being individually preadjusted for exerting pressure, each of said sealing bars pivoting only at a single point.

11. The process according to claim 9 wherein said squared carton comprises a front panel, a rear panel and two side panels and major and minor flaps at first and second ends and said sealing bars are applied to a first end of said squared carton and wherein the carton is supported by at least one of said major flaps at said second end.

12. The apparatus for sealing carton ends according to claim 11 adapted to accommodate a squared carton which includes a front panel, a rear panel and two side panels and major and minor flaps at first and second ends and adapted to apply the sealing bars to a first end of the squared carton while the carton is supported by at least one of the major flaps at the second end.

13. The process according to claim 9 wherein each of said sealing bars pivots at one of its ends.

14. The apparatus of claim 10 wherein each of said sealing bars pivots at one of its ends.

15. The process according to claim 9 wherein the major sealing flaps each extend less than the full width of the carton.

* * * * *